US005443402A

United States Patent [19]

Huang

[11] Patent Number: 5,443,402

[45] Date of Patent: Aug. 22, 1995

[54] CHRISTMAS LAMP SOCKET

[76] Inventor: Shun-Feng Huang, No. 13, Lane 84, Nei Hu Road, Hsin-Chu City,

[21] Appl. No.: 336,733

[22] Filed: Nov. 7, 1994

[51] Int. Cl.[6] ..... H01R 17/00

[52] U.S. Cl. ..... 439/699.2; 439/619

[58] Field of Search ..... 439/699, 619, 370–372, 439/345

[56] References Cited

U.S. PATENT DOCUMENTS

| | | | |
|---|---|---|---|
| 4,970,632 | 11/1990 | Tseng | 362/226 |
| 5,094,632 | 3/1992 | Chen et al. | 439/699 |
| 5,372,525 | 12/1994 | Wu et al. | 439/656 |

*Primary Examiner*—Larry I. Schwartz
*Assistant Examiner*—Jill DeMello
*Attorney, Agent, or Firm*—Morton J. Rosenberg; David I. Klein

[57] ABSTRACT

A Christmas lamp socket includes an upper socket for a Christmas lamp to fit therein, and a lower socket for the upper socket to fit therein is provided. The upper socket has a fitting bar extending transversely from an upper edge and is able to be bent so as to be received within a substantially cylindrically shaped opening of a C-shaped projection extending transversely from an upper edge of the lower socket to firmly secure the upper socket to the lower socket.

1 Claim, 2 Drawing Sheets

CHRISTMAS LAMP SOCKET

BACKGROUND OF THE INVENTION

This invention concerns a Christmas lamp socket, particularly one consisting of an inner socket and an outer socket, and the inner socket is fitted firmly in the outer socket to stably keep a Christmas lamp in the inner socket.

A known conventional Christmas lamp socket shown in FIG. 3, includes an inner socket 20, and an outer socket 30 for the inner socket 20 to fit in a hole of the outer socket 30. The inner socket 20 has two holes 201, 201 in its bottom for two lamp lead pins to pass through down and then to be bent on an outer surface of the inner socket. A disadvantage of this conventional Christmas lamp socket is rather complicated for manufacturing, costing much.

A known conventional Christmas lamp socket shown in FIG. 4 is an improved one of that shown in FIG. 3, having an inner socket 50 and an outer socket 60 combined together. The inner socket 50 has two holes 502, 502 in its bottom for two lead pins to pass through down and then to be bent up on an outer surface of the inner socket 50 to combine the Christmas lamp 40 with the inner socket 50. Then the inner socket 50 is fitted in the outer socket 60. In addition, the inner socket 50 is provided with a sidewise vertical plate 503 with a hole 504 at an upper edge, and the outer socket 60 has a bar 601 extending out from an upper edge so as to fit through the hole 504 of the inner socket 50 so that the inner socket 50 and the outer socket 60 may be combined together stably. But the hole 504 and the bar 601 does not fit with each other closely, liable to separate from each other in case of outer striking force received and consequently the inner socket 50 will separate from the outer socket 60.

SUMMARY OF THE INVENTION

The present invention has been devised to offer a kind of Christmas lamp socket improved to have a more stabilized structure for holding a Christmas lamp therein.

A Christmas lamp socket in the present invention includes an inner socket and an outer socket combined together. The inner socket is fitted in an upper portion of the outer socket, having two holes in the bottom for two lead pins of a Christmas lamp to pass through and a sidewise T-shaped bar extending out diametrically from an upper edge. The outer socket has a C-shaped projection extending diametrically from an upper edge for the T-shaped bar of the inner socket to be bent down and fit tightly therein, so as to combine the inner socket, such being with the outer socket very stabilized to resist outer force received for keeping both the sockets always together.

BRIEF DESCRIPTION OF DRAWINGS

The invention will be better understood by reference to the accompanying drawings, wherein.

DESCRIPTION OF PREFERRED EMBODIMENTS

Figure 1:
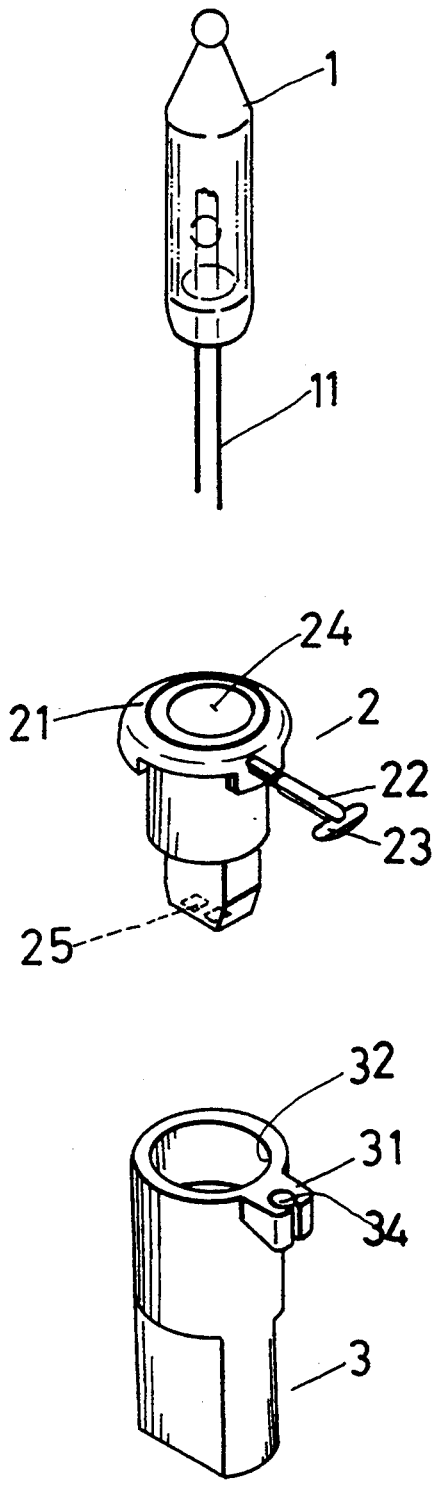
FIG. 1 is an exploded perspective view of a Christmas lamp socket in the present invention.

A Christmas lamp socket in the present invention, as shown in FIG. 1 includes an upper socket 2, and a lower socket 3 combined together for holding a Christmas lamp 1 therein.

The lamp 1 is a common lamp used for Christmas decoration, having two lead pins 11, 11 at bottom.

The inner socket 2 has a larger diameter upper flat circumferential surface 21, a fitting bar 22 projecting out sideways from the surface 21 and having a stop projection 23 formed at the tip of the bar 22 in a right angle, a center hole 24 for the lamp 1 to fit therein, and two holes 25, 25 in the bottom for the two lead pins 11 of the lamp 1 to pass through.

The outer socket 3 has a center round hole 32 in an upper half portion for the inner socket 2 to fit therein, a C-shaped projection 31 having a substantially cylindrical opening 34, extending sideways from an upper wall defining the center hole 32, a rectangular hole 33 provided under the center round hole 32 in a lower half portion so that the inner socket may fit exactly in the rectangular hole 33 and the center round hole 32 in a stabilized condition.

Figure 2:
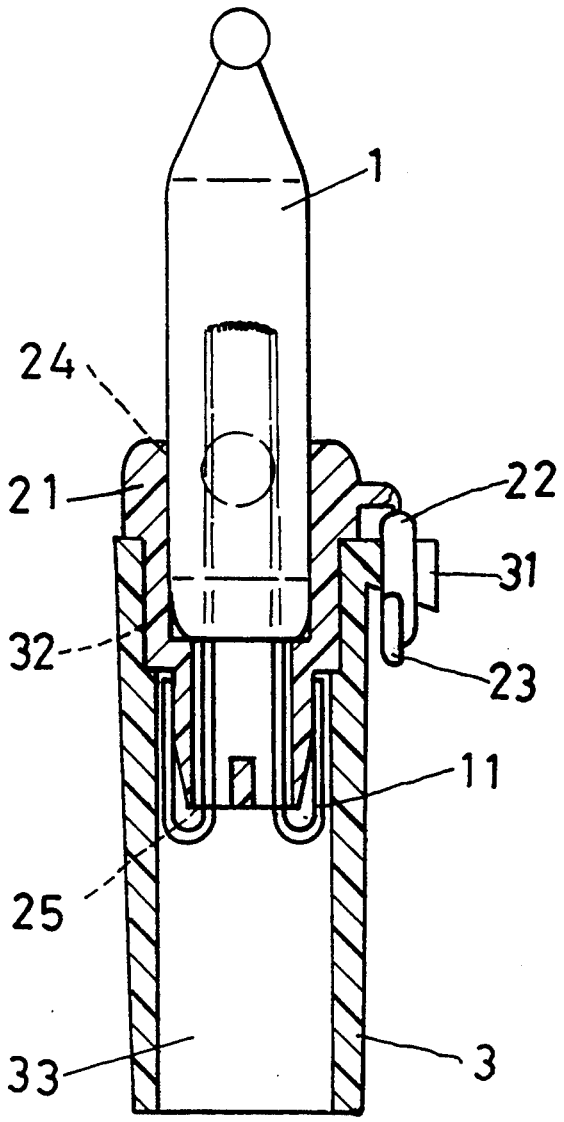
FIG. 2 is a side cross-sectional view of the Christmas lamp socket in the present invention.
Figure 3:
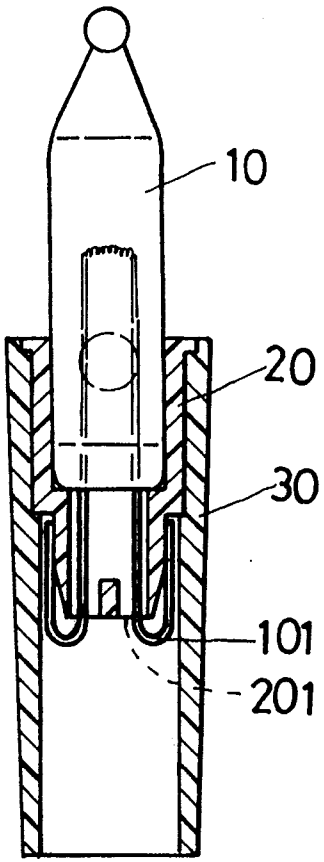
FIG. 3 (PRIOR ART)
FIG. 3 is a side cross-sectional view of a known conventional Christmas lamp socket; and, FIG. 4 is a side cross-sectional view of another known conventional Christmas lamp socket.
Figure 4:
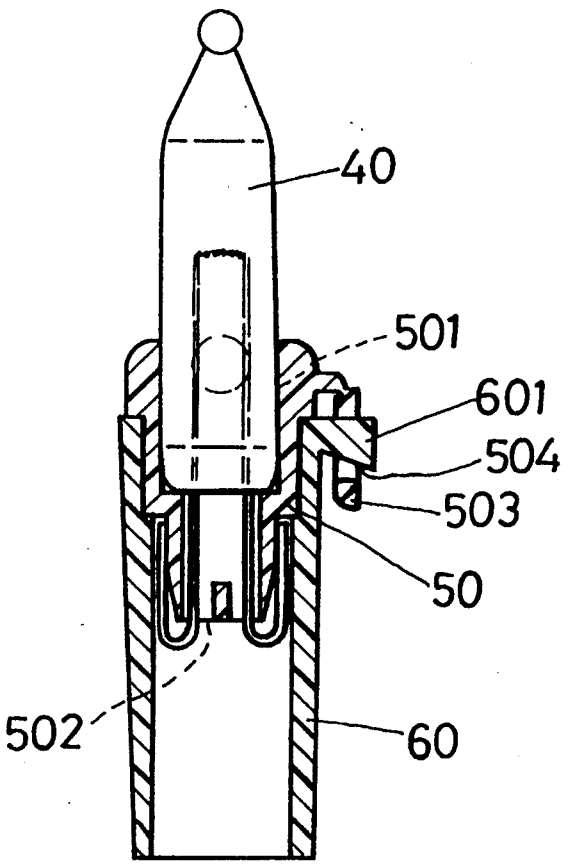
FIG. 4 (PRIOR ART)

In assembling, as shown in FIG. 2, firstly, the lamp 1 is put in the center hole 24 of the upper socket 2, letting the two lead pins 11 of the lamp 1 to pass through the two holes 25, 25 down and then to be bent up on the outer surface of the inner socket 2. Next, the inner socket 2 together with the lamp 1 is put in the center hole 31 and the rectangular hole 33 of the outer socket 3, with the elastic fitting bar 22 bent down to fit in the center opening 34 of the C-shaped projection 31 of the outer socket 3, and the stop projection 23 closely contacts with the lower edge of the C-shaped projection 31 so that the lamp 1 may be kept in its position with proper tightness to resist outer force. In case the lamp 1 is needed to be replaced with a new one, the fitting bar 22 is manually pushed up to disengage from the opening 34 of the C-shaped projection 31, freeing the inner socket 2 from the outer socket 3 to allow the lamp 1 taken out of the inner socket 2.

While the preferred embodiment of the invention have been described above, it will be recognized an understood that various modifications may be made therein and the appended claims are intended to cover all such modfication which may fall within the spirit and scope of the invention.

What is claimed is:

1. A Christmas lamp socket comprising an upper socket and a lower socket combined together, said upper socket having a center hole for a Christmas lamp to fit therein, and two holes in its bottom for two lead pins of said lamp to pass through and then are bent over an outer surface of a lower portion of said upper socket, said lower socket having a center round hole for said upper socket to fit therein, and characterized by said lower socket having a C-shaped projection extending from a side of an upper circumferential wall of said lower socket, said C-shaped projection having a substantially circular cylindrical through opening formed therein, said upper socket having an annular flat portion extending around an upper circumferential edge thereof and an elastic circular cylindrical fitting bar extending transversely from said annular flat portion, said elastic fitting bar having a stop projection formed at a substantially right angle at its tip, said fitting bar being displaceable to be tightly engaged within said substantially circular cylindrical opening of said C-shaped projection after said upper socket is deposited in said lower socket.

* * * * *